US006357253B1

(12) United States Patent
Condy

(10) Patent No.: US 6,357,253 B1
(45) Date of Patent: Mar. 19, 2002

(54) WINE BOTTLE COOLING DEVICE

(76) Inventor: Darryl A. Condy, 1184 Cynthia Lane, Oakville, Ontario (CA), L6J 2W3

( * ) Notice: Subject to any disclaimer, the term of this patent is extended or adjusted under 35 U.S.C. 154(b) by 0 days.

(21) Appl. No.: 09/765,594

(22) Filed: Jan. 22, 2001

(51) Int. Cl.[7] ..... F25D 3/08
(52) U.S. Cl. ..... 62/457.8; 62/371; 62/530
(58) Field of Search ..... 62/457.8, 457.4, 62/457.5, 400, 438, 371, 530, 411

(56) References Cited

U.S. PATENT DOCUMENTS

| | | | | | |
|---|---|---|---|---|---|
| 3,205,678 | A | * | 9/1965 | Stoner | 62/457 |
| 3,998,072 | A | * | 12/1976 | Shaw | 62/457 |
| D259,614 | S | | 6/1981 | Angelakos | |
| D272,882 | S | | 3/1984 | Gardner et al. | |
| 4,638,645 | A | * | 1/1987 | Simila | 62/457 |
| D290,572 | S | | 6/1987 | Verduyn | |
| 4,747,274 | A | * | 5/1988 | Zitzmann | 62/371 |
| 4,798,063 | A | * | 1/1989 | Rimmer | 62/457 |
| 4,882,914 | A | | 11/1989 | Haines-Keeley et al. | |
| D373,513 | S | | 9/1996 | Jorgenson | |
| 5,651,254 | A | | 7/1997 | Berry | |
| 5,904,267 | A | | 5/1999 | Thompson | |
| 5,924,304 | A | * | 7/1999 | Sanchez | 62/457.7 |
| 6,101,838 | A | * | 8/2000 | Teague | 62/457.4 |

* cited by examiner

*Primary Examiner*—William Doerrler
*Assistant Examiner*—Melvin Jones

(57) ABSTRACT

A wine bottle cooling device for chilling a wine bottle disposed within the device. The wine bottle cooling device includes a housing having a bottom wall and a peripheral wall integrally coupled to and extending upwardly from the bottom wall. An inner surface and an outer surface of the bottom and peripheral walls are separated by a hollow space. The hollow space is substantially filled with a fluid having a freezing point less than −5 degrees Celsius.

7 Claims, 4 Drawing Sheets

WINE BOTTLE COOLING DEVICE

BACKGROUND OF THE INVENTION

1. Field of the Invention

The present invention relates to wine bottle cooling devices and more particularly pertains to a new wine bottle cooling device for chilling a wine bottle disposed within the device.

2. Description of the Prior Art

The use of wine bottle cooling devices is known in the prior art. More specifically, wine bottle cooling devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,882,914; U.S. Pat. No. 5,904,267; U.S. Des. Pat. No. 259.614; U.S. Pat. No. 5,651,254; U.S. Des. Pat. No. 373,513; U.S. Des. Pat. No. 290,572; and U.S. Des. Pat. No. 272,882.

While these devices fulfill their respective, particular objectives and requirements, the aforementioned patents do not disclose a new wine bottle cooling device. The inventive device includes a housing having a bottom wall and a peripheral wall integrally coupled to and extending upwardly from the bottom wall. An inner surface and an outer surface of the bottom and peripheral walls are separated by a hollow space. The hollow space is substantially filled with a fluid having a freezing point less than −5 degrees Celsius.

In these respects, the wine bottle cooling device according to the present invention substantially departs from the conventional concepts and designs of the prior art, and in so doing provides an apparatus primarily developed for the purpose of chilling a wine bottle disposed within the device.

SUMMARY OF THE INVENTION

In view of the foregoing disadvantages inherent in the known types of wine bottle cooling devices now present in the prior art, the present invention provides a new wine bottle cooling device construction wherein the same can be utilized for chilling a wine bottle disposed within the device.

The general purpose of the present invention, which will be described subsequently in greater detail, is to provide a new wine bottle cooling device apparatus and method which has many of the advantages of the wine bottle cooling devices mentioned heretofore and many novel features that result in a new wine bottle cooling device which is not anticipated, rendered obvious, suggested, or even implied by any of the prior art wine bottle cooling devices. either alone or in any combination thereof.

To attain this, the present invention generally comprises a housing having a bottom wall and a peripheral wall integrally coupled to and extending upwardly from the bottom wall. An inner surface and an outer surface of the bottom and peripheral walls are separated by a hollow space. The hollow space is substantially filled with a fluid having a freezing point less than −5 degrees Celsius.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new wine bottle cooling device apparatus and method which has many of the advantages of the wine bottle cooling devices mentioned heretofore and many novel features that result in a new wine bottle cooling device which is not anticipated, rendered obvious, suggested, or even implied by any of the prior art wine bottle cooling devices, either alone or in any combination thereof.

It is another object of the present invention to provide a new wine bottle cooling device which may be easily and efficiently manufactured and marketed.

It is a further object of the present invention to provide a new wine bottle cooling device which is of a durable and reliable construction.

An even further object of the present invention is to provide a new wine bottle cooling device which is susceptible of a low cost of manufacture with regard to both materials and labor, and which accordingly is then susceptible of low prices of sale to the consuming public, thereby making such wine bottle cooling device economically available to the buying public.

Still yet another object of the present invention is to provide a new wine bottle cooling device which provides in the apparatuses and methods of the prior art some of the advantages thereof, while simultaneously overcoming some of the disadvantages normally associated therewith.

Still another object of the present invention is to provide a new wine bottle cooling device for chilling a wine bottle disposed within the device.

Yet another object of the present invention is to provide a new wine bottle cooling device which includes a housing having a bottom wall and a peripheral wall integrally coupled to and extending upwardly from the bottom wall. An inner surface and an outer surface of the bottom and peripheral walls are separated by a hollow space. The hollow space is substantially filled with a fluid having a freezing point less than −5 degrees Celsius.

Still yet another object of the present invention is to provide a new wine bottle cooling device that may be chilled to a temperature below freezing to quickly chill a wine bottle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
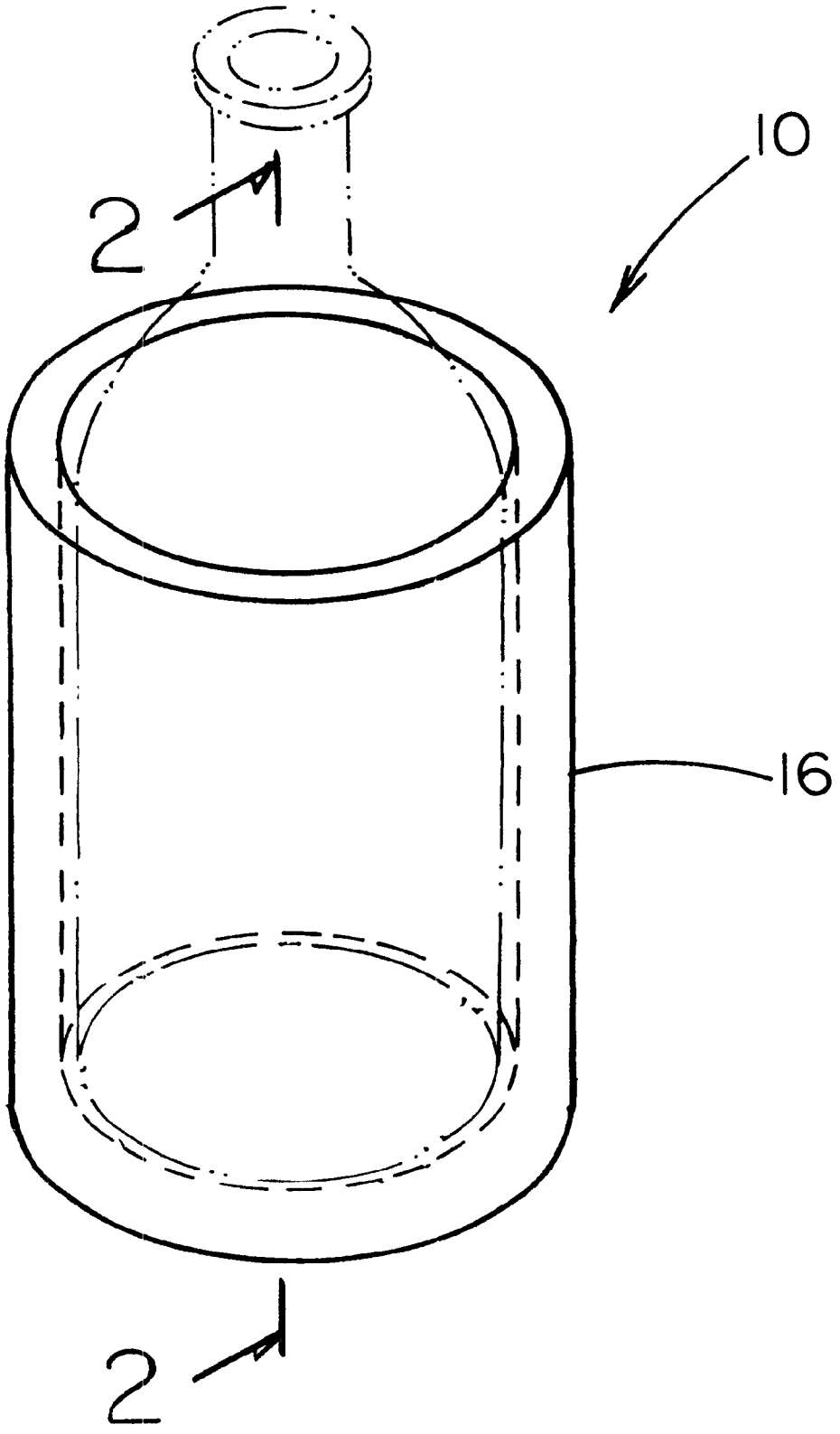
FIG. 1 is a schematic perspective view of the first embodiment of a new wine bottle cooling device according to the present invention.

With reference now to the drawings, and in particular to FIGS. 1 through 5 thereof, a new wine bottle cooling device embodying the principles and concepts of the present invention and generally designated by the reference numeral 10 will be described.

Figure 2:
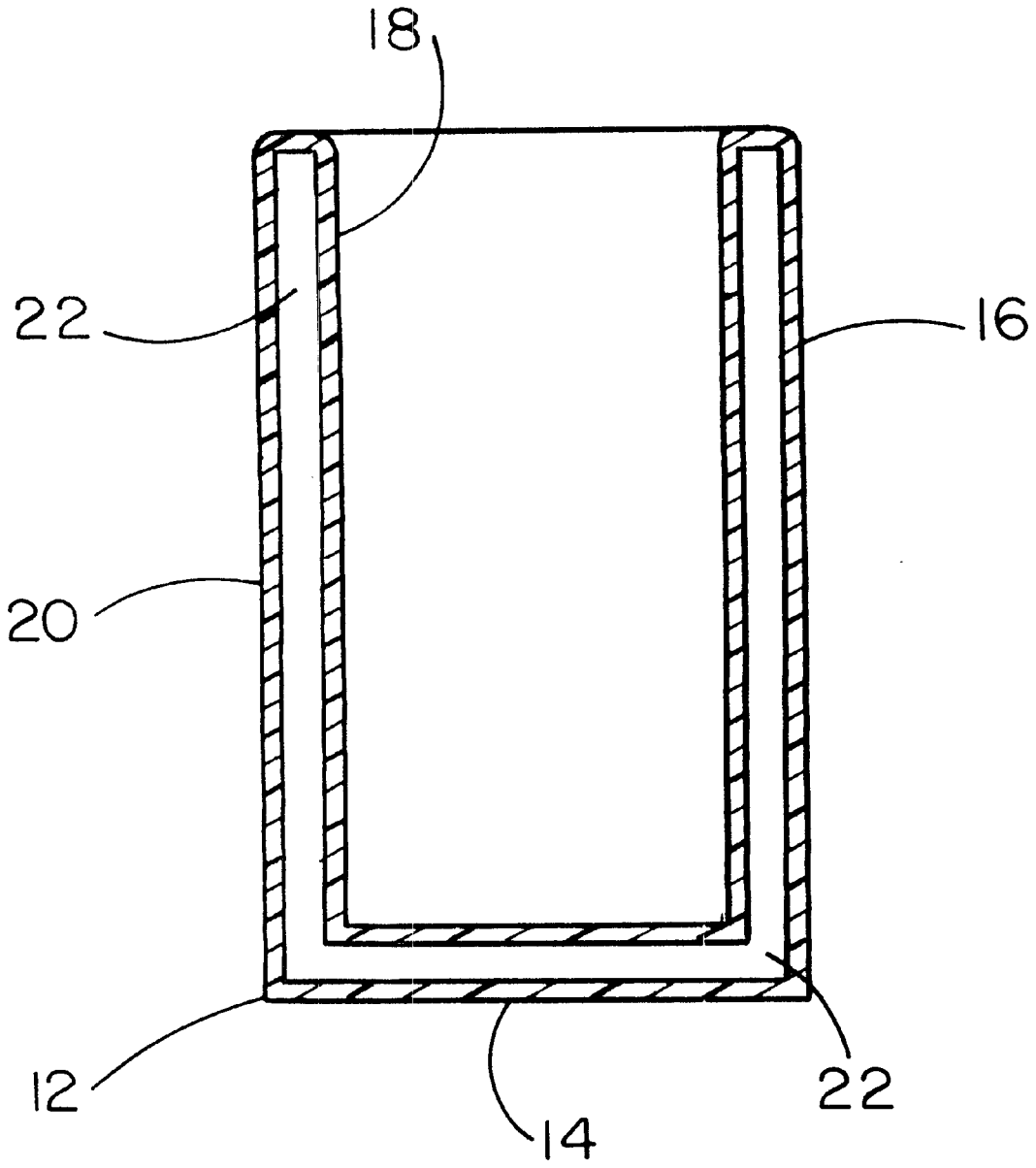
FIG. 2 is a schematic cross-sectional view taken along line 2—2 of the first embodiment of the present invention.

As best illustrated in FIGS. 1 and 2, the first embodiment of the wine bottle cooling device 10 generally comprises a housing 12 having a bottom wall 14 and a peripheral wall 16 is integrally coupled to and extending upwardly from the bottom wall 12. An inner surface 18 and an outer surface 20 of the bottom 14 and peripheral 16 walls are separated by a hollow space 22. The hollow space 22 is substantially filled with fluid has a freezing point less than −5 degrees Celsius. The fluid preferably comprises ethylene glycol. The peripheral wall 16 has a height preferably between 8 inches and 12 inches. The peripheral wall 16 ideally has a cylindrical shape and has a diameter generally between 3 inches and 6 inches. The housing 12 is preferably comprised of a plastic material.

Figure 3:
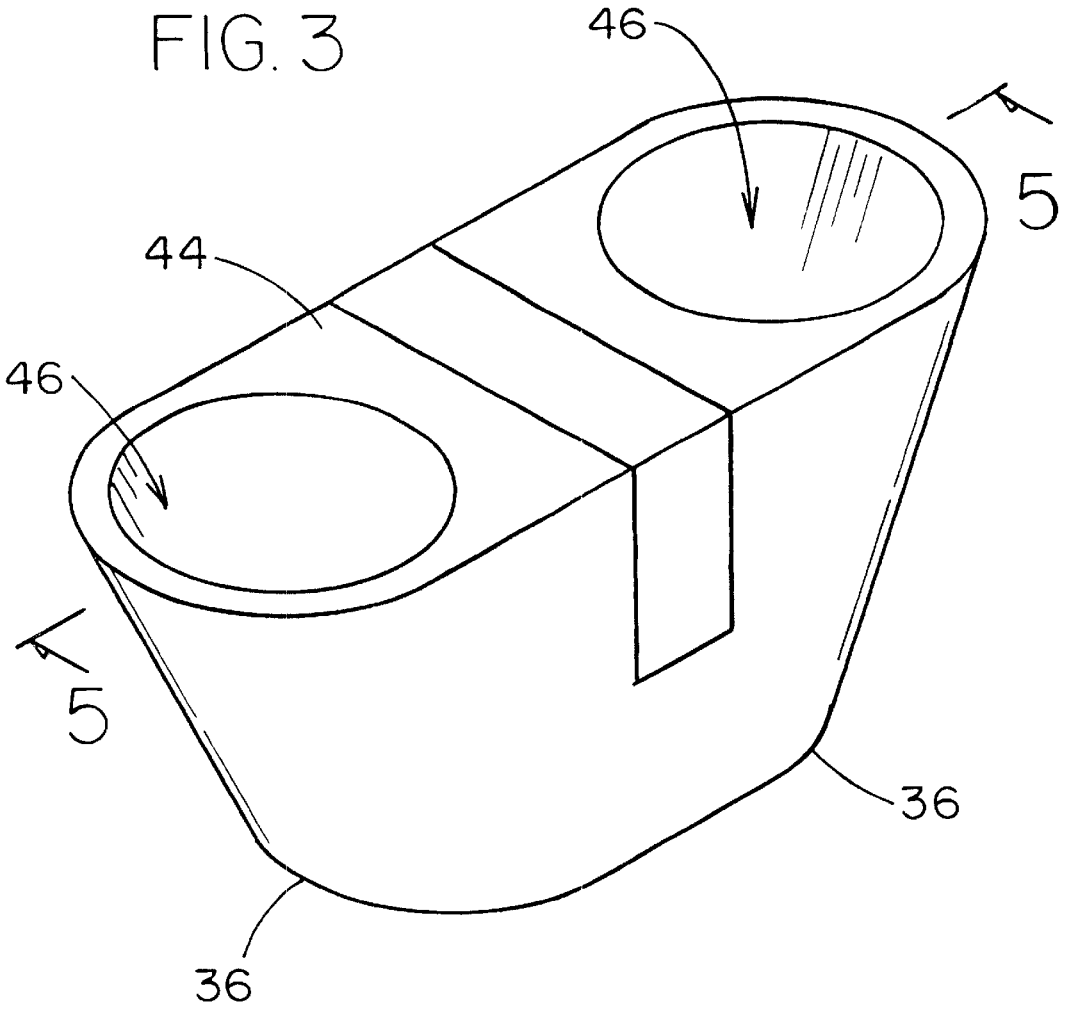
FIG. 3 is a schematic perspective view of the second embodiment of the present invention.
Figure 4:
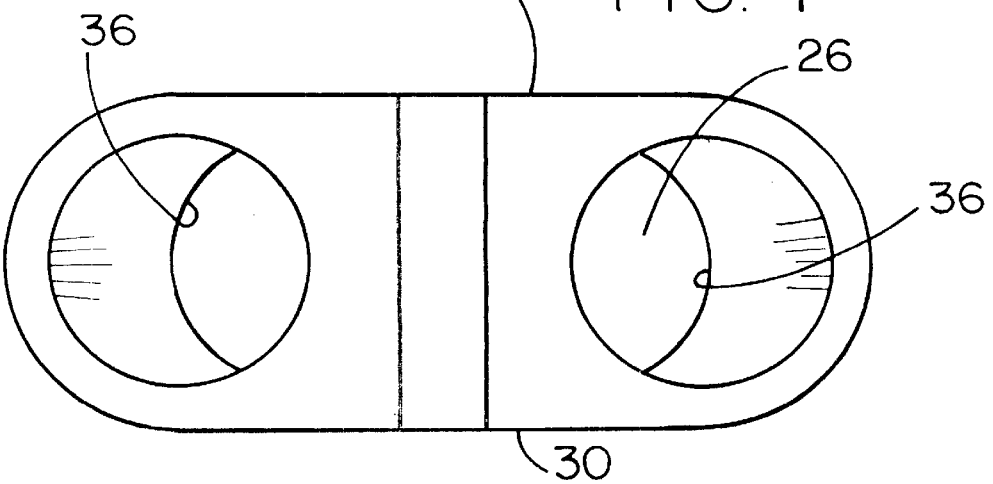
FIG. 4 is a schematic top view of the present invention.
Figure 5:
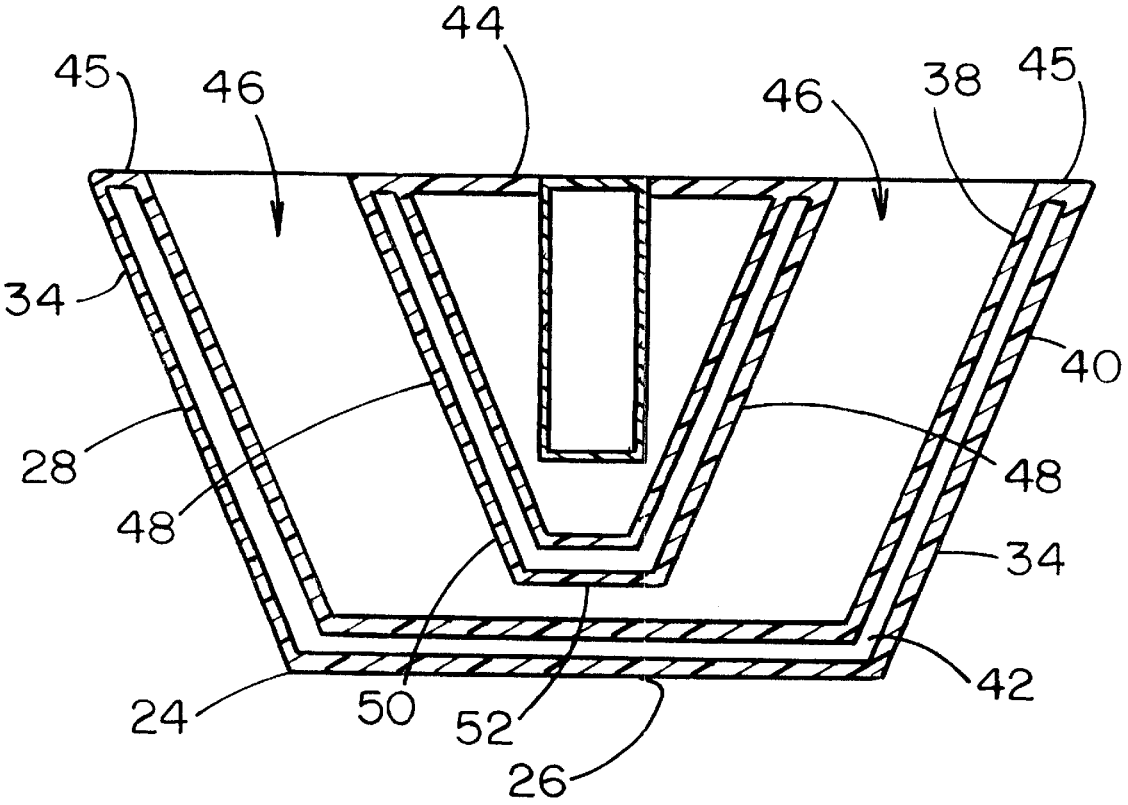
FIG. 5 is a schematic cross-sectional view taken along line 5—5 of the present invention.

FIGS. 3 through 5 depict the second embodiment of the invention and included a housing 24 having a bottom wall 26 and a peripheral wall 28 integrally coupled to and extending upwardly from the bottom wall 26. The bottom wall 26 has a generally oblong shape. The peripheral wall 28 includes a front wall 30, a back wall 32 and a pair of end walls 34. Each of the end walls 34 extends upwardly from one of two arcuate portions 36 of the bottom wall 26. Each of the end walls 34 angles outwardly from the bottom wall 26. An inner surface 38 and an outer surface 40 of the bottom 26 and peripheral 28 walls are separated by a hollow space 42. The hollow space 42 is substantially filled with fluid having a freezing point less than −5 degrees Celsius. A top wall 44 is securely coupled to a top edge 45 of the peripheral wall 28. The top wall 44 has a pair of openings 46 therein for accessing an interior of the housing 12. Each of the openings 46 is positioned generally adjacent to one of the end walls 34. A pair of intermediate walls 48 are integrally coupled to the top wall 44 and extend downwardly therefrom into the interior of the housing 24. Each of the intermediate walls 48 extends between the front and back walls. Each of the intermediate walls 48 are positioned nearer one of the end walls 34 and adjacent to one of the openings 46 such that an opening 46 is positioned between each of the intermediate walls 48 and a respective end wall 34. The intermediate walls 48 are angled in a same manner as a respectively adjacent end wall 34. The intermediate walls 48 each have a free end 50 positioned within the housing. A second bottom wall 52 extends between and integrally coupled to the free ends 50 of the intermediate walls 48. Each of the intermediate walls 48 and the second bottom wall 52 is hollow and contains the fluid.

In use, the device, either first or second embodiments, is positioned in a freezer to cool the fluid in the hollow walls. Once cooled, a wine bottle may be positioned in the housing, or two bottles in the case of the second embodiment.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bottle chilling device for removably holding and chilling a bottle, said device comprising:

a housing having a bottom wall and a peripheral wall being integrally coupled to and extending upwardly from said bottom wall, an inner surface and an outer surface of said bottom and peripheral walls being separated by a hollow space, said hollow space being substantially filled with a fluid having a freezing point less than −5 degrees Celsius;

wherein said fluid comprises ethylene glycol;

wherein said peripheral wall has a height generally between 8 inches and 12 inches, said peripheral wall having a generally cylindrical shape and having a diameter generally between 3 inches and 6 inches.

2. A bottle chilling device for removably holding and chilling a pair of bottles, said device comprising:

a housing having a bottom wall and a peripheral wall being integrally coupled to and extending upwardly from said bottom wall, said bottom wall having a generally oblong shape, said peripheral wall including a front wall, a back wall and a pair of end walls, each of said end walls extending upwardly from one of two arcuate portions of said bottom wall, each of said end walls angling outwardly from said bottom wall, an inner surface and an outer surface of said bottom and peripheral walls being separated by a hollow space, said hollow space being substantially filled with a fluid having a freezing point less than −5 degrees Celsius, a top wall being securely coupled a top edge of said peripheral wall, said top wall having a pair of openings therein for accessing an interior of said housing, each of said openings being positioned generally adjacent to one of said end walls.

3. The bottle chilling device as in claim 2, further including:

a pair of intermediate walls being integrally coupled to said top wall and extending downwardly therefrom into said interior of said housing, each of said intermediate walls extending between said front and back walls, each of said intermediate walls being positioned nearer one of said end walls, each of said intermediate walls being angled in a same manner as a respectively adjacent end wall, each of said intermediate walls having a free end positioned within said housing, a second bottom wall extending between and integrally coupled to said free ends of said intermediate walls, each of said intermediate walls and said second bottom wall being hollow and containing said fluid.

4. A bottle chilling device for removably holding and chilling a pair of bottles, said device comprising:

a housing having a bottom wall and a peripheral wall being integrally coupled to and extending upwardly from said bottom wall, said bottom wall having a generally oblong shape, said peripheral wall including a front wall, a back wall and a pair of end walls, each of said end walls extending upwardly from one of two arcuate portions of said bottom wall, each of said end walls angling outwardly from said bottom wall, an inner surface and an outer surface of said bottom and peripheral walls being separated by a hollow space, said hollow space being substantially filled with a fluid having a freezing point less than −5 degrees Celsius, a top wall being securely coupled a top edge of said peripheral wall, said top wall having a pair of openings therein for accessing an interior of said housing, each of said openings being positioned generally adjacent to one of said end walls, a pair of intermediate walls being integrally coupled to said top wall and extending downwardly therefrom into said interior of said housing, each of said intermediate walls extending between said front and back walls, each of said intermediate walls being positioned nearer one of said end walls, each of said intermediate walls being angled in a same manner as a respectively adjacent end wall, each of said intermediate walls having a free end positioned within said housing, a second bottom wall extending between and integrally coupled to said free ends of said intermediate walls, each of said intermediate walls and said second bottom wall being hollow and containing said fluid.

5. A bottle chilling device for removably holding and chilling a pair of bottles, said device comprising:

a housing having a bottom wall and a peripheral wall being integrally coupled to and extending upwardly from said bottom wall, said bottom wall having a generally oblong shape, said peripheral wall including a front wall, a back wall and a pair of end walls, each of said end walls extending upwardly from one of two arcuate portions of said bottom wall, each of said end walls angling outwardly from said bottom wall, an inner surface and an outer surface of said bottom and peripheral walls being separated by a hollow space, said hollow space being substantially filled with a fluid, a top wall being securely coupled a top edge of said peripheral wall, said top wall having a pair of openings therein for accessing an interior of said housing, each of said openings being positioned generally adjacent to one of said end walls.

6. The bottle chilling device as in claim 5, further including:

a pair of intermediate walls being integrally coupled to said top wall and extending downwardly therefrom into said interior of said housing, each of said intermediate walls extending between said front and back walls, each of said intermediate walls being positioned nearer one of said end walls, each of said intermediate walls being angled in a same manner as a respectively adjacent end wall, each of said intermediate walls having a free end positioned within said housing, a second bottom wall extending between and integrally coupled to said free ends of said intermediate walls, each of said intermediate walls and said second bottom wall being hollow and containing said fluid.

7. The bottle chilling device as in claim 5, wherein said fluid has a freezing point less than −5 degrees Celsius.

* * * * *